US006227402B1

(12) United States Patent
Shimojima et al.

(10) Patent No.: US 6,227,402 B1
(45) Date of Patent: May 8, 2001

(54) PRESSURE CONTAINER

(75) Inventors: Shingo Shimojima, Aichi-ken; Yojiro Iriyama, Toyota, both of (JP)

(73) Assignee: Toyoda Gosei Co., LTD, Nishikasugai-gun (JP)

( * ) Notice: Subject to any disclaimer, the term of this patent is extended or adjusted under 35 U.S.C. 154(b) by 0 days.

(21) Appl. No.: 09/531,176

(22) Filed: Mar. 21, 2000

(30) Foreign Application Priority Data

Apr. 7, 1999 (JP) ..... 11-099818

(51) Int. Cl.[7] ..... F17C 1/00

(52) U.S. Cl. ..... 220/581; 220/588; 220/589; 220/661

(58) Field of Search ..... 220/581, 586, 220/588, 589, 590, 601, 661

(56) References Cited

U.S. PATENT DOCUMENTS 4,589,563 * 5/1986 Born ..... 220/581
4,690,295 * 9/1987 Wills ..... 220/590
5,253,778 10/1993 Sirosh .
5,287,988 2/1994 Murray .
5,429,845 * 7/1995 Newhouse et al. ..... 220/589 X
5,476,189 * 12/1995 Duvall et al. ..... 220/589 X
5,518,141 * 5/1996 Newhouse et al. ..... 220/590 X
5,551,590 * 9/1996 Mazur et al. ..... 220/586 X
5,979,692 * 11/1999 West ..... 220/589 X

FOREIGN PATENT DOCUMENTS 11-99818 4/1999 (JP) .

* cited by examiner

*Primary Examiner*—Steven Pollard
(74) *Attorney, Agent, or Firm*—Pillsbury Winthrop, LLP

(57) ABSTRACT

A pressure container in accordance with the invention is provided with a mouth piece having a cylindrical boss portion and a flange portion which is protruded from an outer periphery of the boss portion and a synthetic resin liner which is integrally formed in the flange portion. In the pressure container, an annular groove to which an inner peripheral portion of an inner edge portion of the liner is fitted so as to slide in a direction of expanding a diameter is provided on an inner side surface of the flange portion. Accordingly, it is possible to improve a reliability of an airtight seal in a bonding portion between a liner and a mouth piece.

4 Claims, 7 Drawing Sheets

PRESSURE CONTAINER

BACKGROUND OF THE INVENTION

1. Field of the Invention

The present invention relates to a pressure container for filling up various kinds of compressed gas such as a compressed natural gas (CNG) and the like, various kinds of liquefied gas such as a liquefied natural gas (LNG), a liquefied petroleum gas (LPG) and the like, and the other various kinds of pressurizing materials.

2. Description of the Related Art

There has been conventionally known a pressure container 50 for the CNG in which a metal mouth piece 52 is mounted to a polyethylene liner 51 which does not transmit the CNG and outer peripheries of the liner 51 and the mouth piece 52 are coated with an FRP reinforcing layer 53 which satisfies a predetermined pressure resistance standard, as shown in FIG. 7. In the pressure container 50, since a main body portion is kept in an air tight state by the synthetic resin liner 51, there is an advantage that a weight of a vehicle can be reduced in the case of being used as a fuel tank or the like for an automotive vehicle. Further, in order to keep the mouth piece mounting portion in an air tight state, the structure is made such that a coating portion 51*a* for coating the mouth piece 52 from an inner side is provided in the liner 51, thereby pressure contacting the coating portion 51*a* to an inner surface of a boss portion 52*a* and a flange portion 52*b* in the mouth piece 52 by a gas pressure.

However, a coefficient of thermal expansion is greater in the polyethylene liner 51 than the metal mouth piece 52, so that the polyethylene liner 51 is contracted and expanded in accordance with a change of temperature in a relatively greater manner. Accordingly, for example, as shown in FIG. 8, the liner 51 is contracted at a low temperature, the coating portion 51*a* is peeled from the mouth piece 52 and a gap 54 is generated between the both, thereby causing a poor seal. Further, there is a case that a crack is generated in the coating portion 51*a* due to a residual stress caused by a contraction of the liner 51 at a time of forming and a repeated stress caused by a contraction and expansion of the liner 51 in accordance with a change of temperature. As mentioned above, it is not said that the conventional pressure container 50 is perfect in a reliability of an airtight seal in a bonding portion between the liner 51 and the mouth piece 52.

SUMMARY OF THE INVENTION

Then, an object of the present invention is to provide a pressure container which can improve a reliability of an airtight seal in a bonding portion between a liner and a mouth piece.

In order to achieve the object, in accordance with the present invention, there is provided a pressure container comprising:

- a mouth piece having a cylindrical boss portion and a flange portion which is protruded from an outer periphery of the boss portion; and
- a synthetic resin liner which is integrally formed in the flange portion,
- wherein an annular groove to which an inner peripheral portion of an edge portion of the liner is fitted so as to slide in a direction of expanding a diameter is provided on an inner side surface or an outer side surface of the flange portion.

An aspect by which the inner peripheral portion of the edge portion of the liner is fitted to the annular groove so as to slide in the direction of expanding the diameter is not specifically limited, however, the following aspects can be exemplified.

(1) An aspect in which the annular groove is formed in such a manner as to come nearer a center of the mouth piece toward a bottom of the groove, and the inner peripheral portion of the edge portion of the liner is formed so as to coincide with a shape of the annular groove.

(2) An aspect in which the annular groove is formed in an inclined manner so that a bottom side of the groove comes nearer a center of the mouth piece and enters in a direction of a thickness of the flange portion, and the inner peripheral portion of the edge portion of the liner is formed in an inclined shape by being bent so as to coincide with the annular groove.

An angle of incline of the annular groove is not specifically limited, however, it is preferable that the annular groove is inclined at an angle between 10 and 80 degrees with respect to the inner side surface or the outer side surface of the flange portion, and an angle between 20 and 50 degrees is more preferable. It is hard to form the annular groove in the case that the angle of incline is smaller than 10 degrees, and it is hard for the inner peripheral portion of the edge portion to slide from the annular groove when the liner is contracted and expanded in the case that it is greater than 80 degrees, whereby a breaking is easily generated in the bent portion in a side of a base end of the inner peripheral portion due to a stress concentration. Further, it is easier to process the annular groove when the angle of incline is greater than 20 degrees, and it is harder that the stress is concentrated in the bent portion when it is smaller than 50 degrees.

A cross sectional shape of the annular groove is not specifically limited as far as the inner peripheral portion of the edge portion is formed in a slidable shape, and there can be exemplified a shape in which both side walls of the annular groove are parallel to each other and a shape in which a width of the wall in the side of an opening (an inlet) of the both side walls is increased.

A depth of the annular groove is not specifically limited, however, it is preferable to set the depth to a depth at which the fitting is not taken out even when the liner is contracted and the inner peripheral portion of the edge portion is slid.

The flange portion is preferably structured such that a rubber coat is tightly formed on a contact surface with the liner.

In accordance with the pressure container of the present invention, it is possible to improve a reliability of an airtight seal in the bonding portion between the liner and the mouth piece.

In accordance with the pressure container in which the rubber coat is formed on the contact surface of the flange portion with the liner, it is possible to further improve the effect.

DESCRIPTION OF THE PREFERRED EMBODIMENTS

Figure 1:
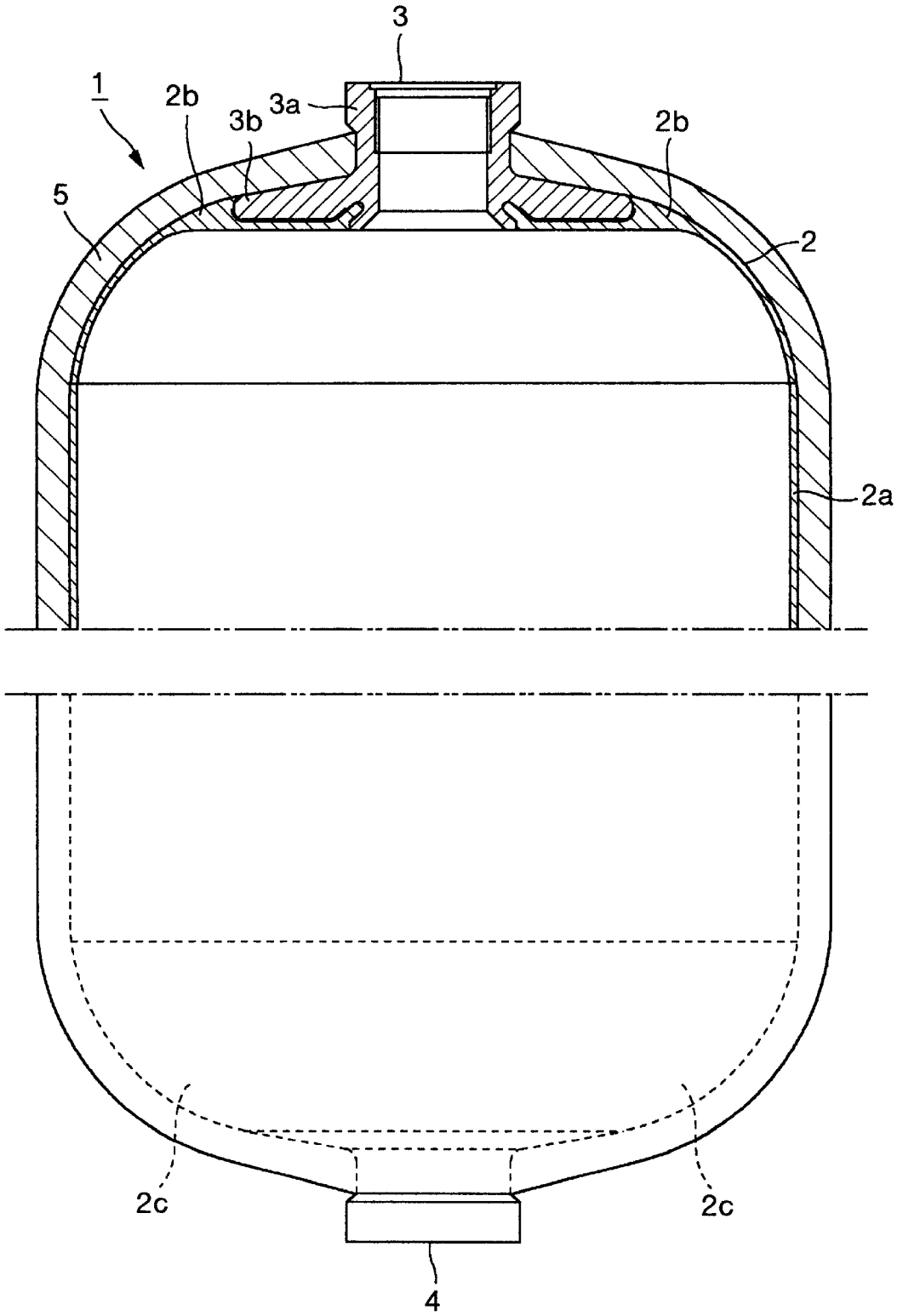
FIG. 1 is a cross sectional view of a pressure container in accordance with a first embodiment of the present invention.

Hereinafter, a description will be given of an embodiment obtained by particularly applying the present invention to a pressure container for a compressed natural gas (CNG) with reference to the accompanying drawings. As shown in FIG. 1, a pressure container 1 in accordance with the present embodiment is constituted by a polyethylene liner 2 which does not transmit the CNG, aluminum mouth pieces 3 and 4 which are mounted to both ends of the liner 2, and an FRP reinforcing layer 5 which covers outer peripheries of the liner 2 and the mouth pieces 3 and 4.

The liner 2 is a cylindrical container in which a cylindrical peripheral wall portion 2*a* and a pair of spherical end wall portions 2*b* and 2*c* are bonded by a welding process. A polyethylene through which the CNG is hard to be transmitted or a resin having higher gas impermeable property (for example, an aliphatic polyketone (product name KALIRON of Shell Japan Co., Ltd) can be employed as a resin material for the liner 2.

The FRP reinforcing layer 5 is formed by winding a reinforcing fiber made of a carbon, a glass or an aramid resin on an outer periphery of the liner 2, thereafter impregnating a resin such as an epoxy or the like into the reinforcing fiber and heating and hardening.

Figure 2:
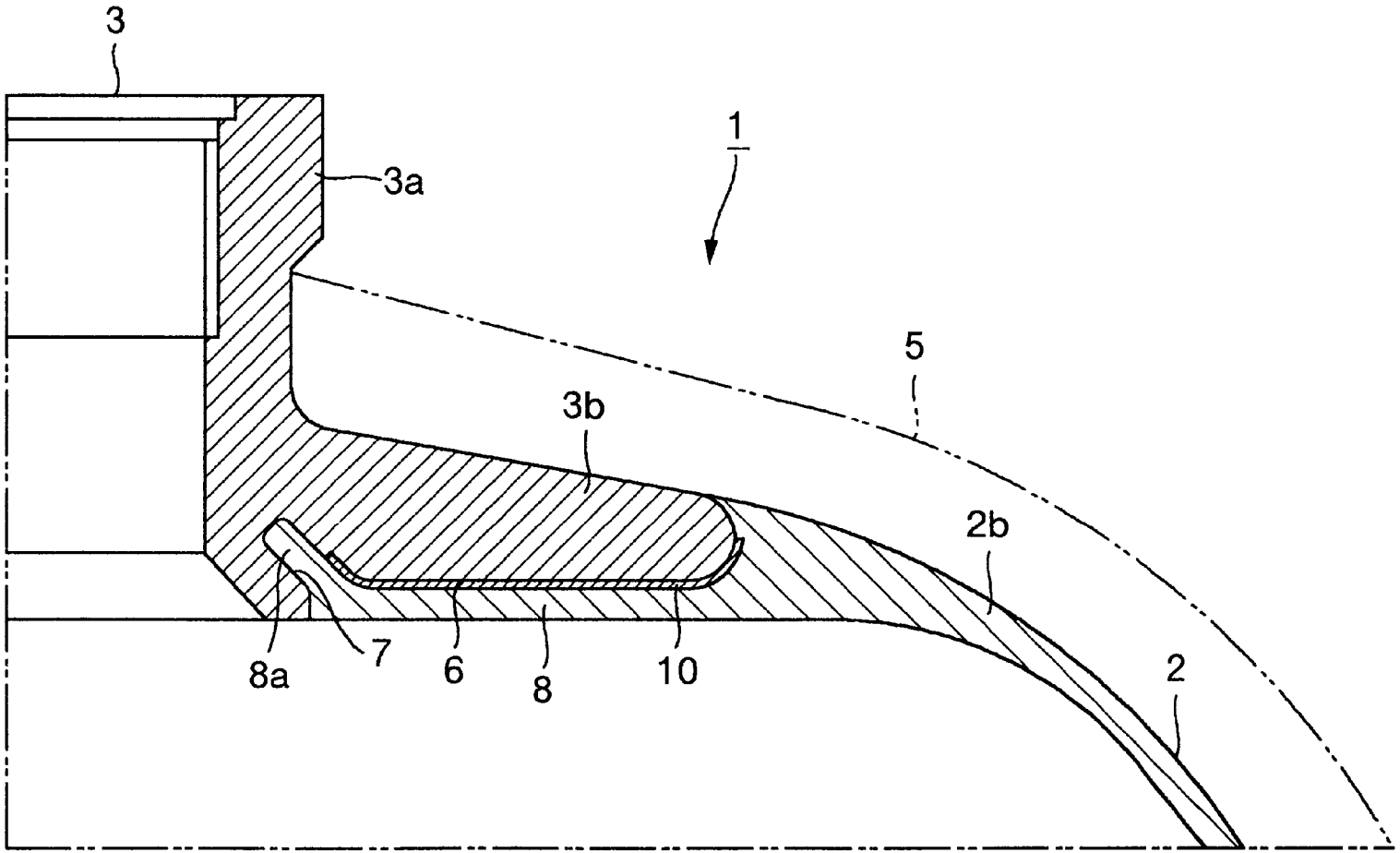
FIG. 2 is an enlarged view of a main portion of FIG. 1 which shows a mounting structure of a mouth piece in the pressure container.

The mouth pieces 3 and 4 are respectively adhered to the center portions of the end wall portions 2*b* and 2*c*. One mouth piece 3 is structured such as to connect a piping joint (not shown) and another mouth piece 4 is structured such as to serve as a sealing plug. Since adhering structures of the mouth pieces 3 and 4 to the end wall portions 2*b* and 2*c* are the same, hereinafter, a description will be given of only the mouth piece 3. As shown in FIG. 2, the mouth piece 3 includes a cylindrical boss portion 3*a* and a flange portion 3*b* which is protruded from an outer periphery of the boss portion 3*a*. An inclined annular groove 7 structured such that a groove bottom side thereof comes near a center of the mouth piece 3 and enters in a direction of a thickness of the flange portion 3*b* is formed on an inner side surface 6 facing to the liner 2 in the flange portion 3*b*. A rubber coat 10 is bonded in a vulcanization manner or coated on the inner side surface 6 of the flange portion 3*b* in an outer peripheral side of the annular groove 7. Then, the end wall portion 2*b* is injection molded by setting the mouth piece 3 to an insert. The inner side surface 6 of the flange portion 3*b* is coated with an inner edge portion 8 of the end wall portion 2*b*, and the inner edge portion 8 is formed in an inclined shape so that an inner peripheral portion 8*a* thereof is bent so as to coincide with the annular groove 7, and is fitted into the annular groove 7 so as to freely slide in a direction of expanding the diameter.

An angle of incline A1 of the annular groove 7 (refer to FIG. 3) is set to, for example, 40 degrees with respect to the inner side surface 6 of the flange portion 3*b*. A cross sectional shape of the annular groove 7 is formed, for example, in a shape in which both side walls 7*a* are parallel to each other. A depth of the annular groove 7 is set to a depth at which a fitting between the annular groove 7 and the inner peripheral portion 8*a* is not taken out even when the liner 2 is contracted and is slid in a direction that the inner peripheral portion 8*a* is taken out from the annular groove 7.

A description will be given of an operation of a mounting structure in the pressure container 1 structured in the manner mentioned above. For example, when the liner 2 is contracted due to a change of temperature or the like, a stress is generated in a direction shown by a single dot chain line arrow R1 in FIG. 3. Since the inner peripheral portion 8*a* of the inner edge portion 8 is slidably fitted to the annular groove 7, the inner peripheral portion 8*a* slides in a direction of taking out from the annular groove 7 and becomes in a state shown by a double dot chain line in FIG. 3, so that the stress is reduced. Then, a fitting state between the inner peripheral portion 8*a* and the annular groove 7 is maintained after the sliding operation, and the inner edge portion 8 is closely attached to the flange portion. At this time, the base end side 8*b* of the inner peripheral portion 8*a* is pressure contact with the rubber coat 10.

Figure 3:
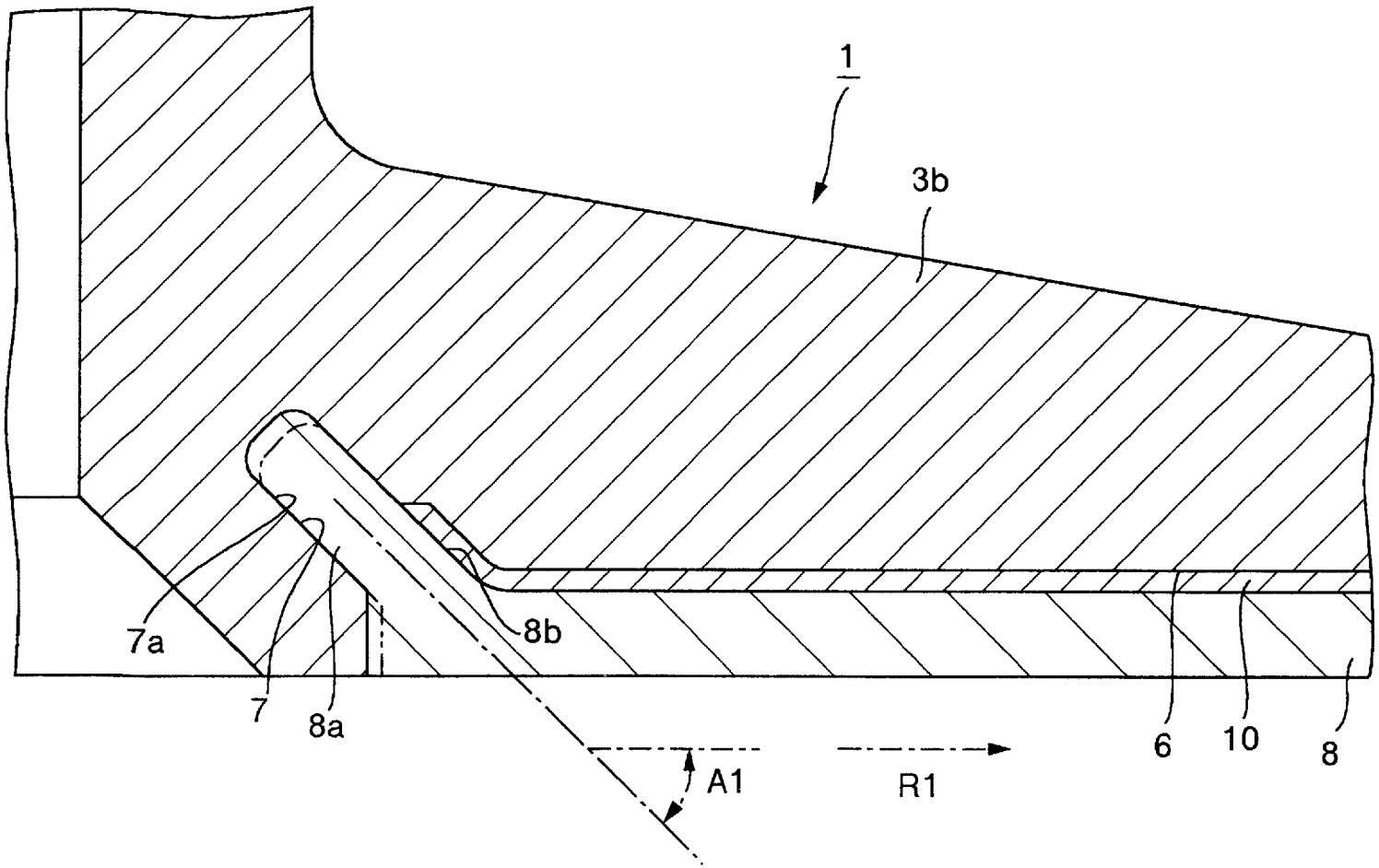
FIG. 3 is a view which shows an operation of the mounting structure.

Further, on the contrary, in the case that the liner 2 expands from the state shown by the double dot chain line in FIG. 3, the inner peripheral portion 8*a* of the inner edge portion 8 slides in a direction of entering into the annular groove 7, thereby reducing the stress and maintaining the fitting state between the inner peripheral portion 8*a* and the annular groove 7.

As mentioned above, in accordance with the pressure container of the present embodiment, since the annular groove 7 of the flange portion 3*b* and the inner peripheral portion 8*a* of the inner edge portion 8 of the liner 2 are slidably fitted, the stress generated by the liner 2 being contracted and expanded due to the change of temperature or the like can be reduced by the inner peripheral portion 8*a* being slid. Accordingly, a breaking is hard to be generated in the inner edge portion 8 of the liner 2.

Further, since the fitting state between the annular groove 7 and the inner peripheral portion 8*a* of the inner edge portion 8 is maintained after the sliding motion, the inner edge portion 8 floats up from the flange portion, so that a sealing property is not deteriorated.

Further, since the inner edge portion 8 is pressure contact with the rubber coat 10 in the flange portion 3*b* by being bent due to the gas pressure, an airtight seal between the liner 2 and the mouth piece 3 is secured as the pressure becomes higher. Further, since the annular groove 7 is formed in an inclined manner and the inner peripheral portion 8*a* of the inner edge portion 8 of the liner 2 is formed in an incline shape by being bent so as to coincide with the annular groove 7, the base end side 8*b* of the inner peripheral portion 8*a* is pressure contact with the rubber coat 10 when the liner 2 is contracted, so that the structure is made such that a sealing effect is increased.

As mentioned above, in accordance with the pressure container 1 of the present embodiment, it is possible to improve a reliability of an airtight seal in the mouth piece mounting portion.

Figure 4:
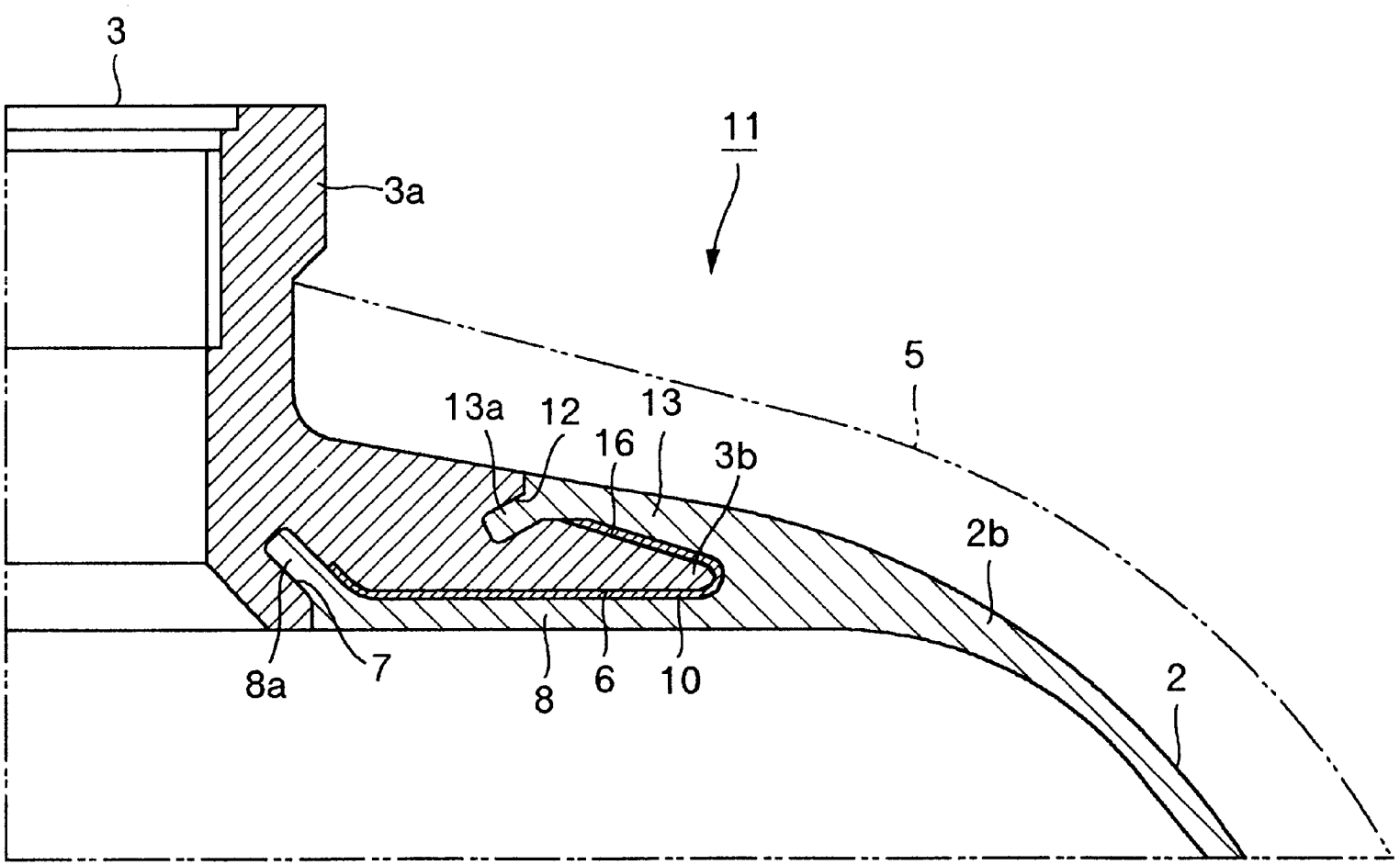
FIG. 4 is a cross sectional view of a pressure container in accordance with a second embodiment of the present invention.

Next, FIG. 4 shows a pressure container 11 in accordance with a second embodiment, the pressure container 11 is different from the first embodiment only in a point that an outer annular groove 12 to which an inner peripheral portion 13*a* of an outer edge portion 13 of the liner 2 is slidably fitted in a direction of expanding the diameter is provided on an outer side surface of the flange portion.

The outer annular groove 12 of the flange portion 3*b* is formed in an inclined manner so that a groove bottom side thereof comes near the center of the mouth piece 3 and enters into a direction of the thickness of the flange portion 3*b*. In a portion which is in contact with the inner edge portion 8 and the outer edge portion 13, the rubber coat 10 is bonded in a vulcanization manner or coated on both of the inner and outer surfaces of the flange portion 3*b*.

The outer edge portion 13 which covers an outer side surface 16 of the flange portion 3*b* is formed in the end wall portion 2*b* of the liner 2. The outer edge portion 13 is formed in an inclined shape by being bent so that the inner peripheral portion 13*a* thereof coincides with the outer annular groove 12, and is fitted into the outer annular groove 12 so as to slide n the direction of expanding the diameter.

An angle of incline A2 of the outer annular groove 12 (refer to FIG. 5) is inclined with respect to an outer side surface 16 of the flange portion 3*b*, for example, at 35 degrees. The outer annular groove 12 is formed, for example, so that a cross sectional shape and a depth thereof are the same as those of annular groove 7.

Figure 5:
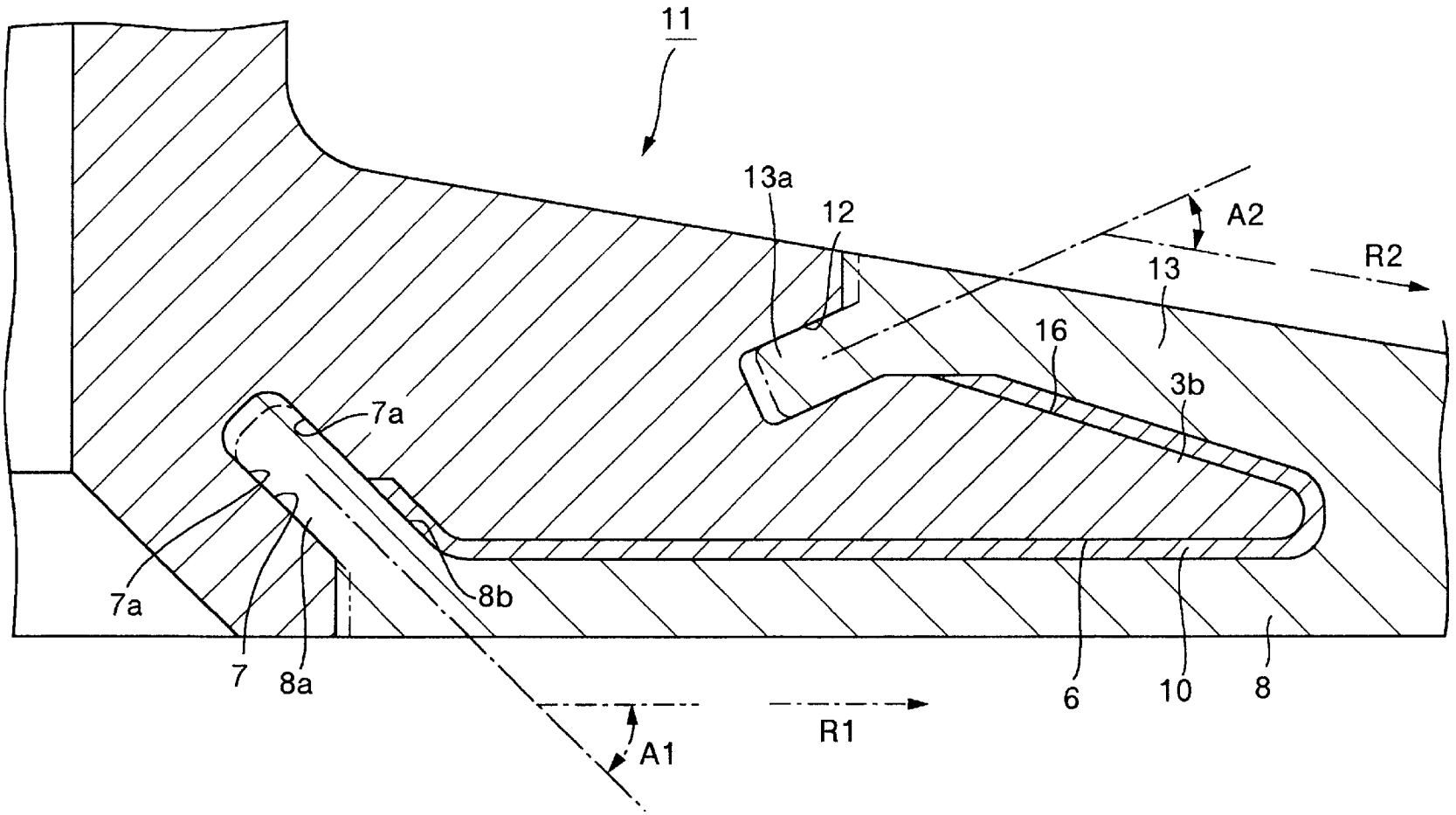
FIG. 5 is a view which shows an operation of a mounting structure thereof.

In the mounting structure in the pressure container 11 structured in the manner mentioned above, for example, when the liner 2 is contracted due to the change of temperature or the like, the stress is generated in a direction shown by a single dot chain line arrow R2 in FIG. 5 and the structure becomes a state shown by a double dot chain line in FIG. 5, so that the annular groove 7 and the inner peripheral portion 8*a* of the inner edge portion 8, and the outer annular groove 12 and the inner peripheral portion 13*a* of the outer edge portion 13 both perform the same operation as that of the annular groove 7 and the inner peripheral portion 8*a* of the inner edge portion 8 in the first embodiment. Further, on the contrary, also in the case that the liner 2 expands from the state shown by the double dot chain line in FIG. 5, the annular groove 7 and the inner peripheral portion 8*a* of the inner edge portion 8, and the outer annular groove 12 and the inner peripheral portion 13*a* of the outer edge portion 13 both perform the same operation as that of the annular groove 7 and the inner peripheral portion 8*a* of the inner edge portion 8 in the first embodiment.

In accordance with the pressure container 11 of the present embodiment, since the outer edge portion 13 is held to the flange portion 3*b* due to the fitting between the outer annular groove 12 and the inner peripheral portion 13*a* of the outer edge portion 13, the same effect as that of the inner edge portion 8 can be obtained in the outer edge portion 13. Further, since the outer edge portion 13 is pressed to the flange portion 3*b* by the FRP reinforcing layer 5, it is bonded to the flange portion 3*b* in a stronger manner than the inner edge portion 8. As mentioned above, since the inner edge portion 8 and the outer edge portion 13 in the liner 2 hold the flange portion 3*b* of the mouth piece 3 therebetween, it is possible to complete the airtight seal of the mouth piece mounting portion.

In this case, the present invention is not limited to the embodiments mentioned above, and can be suitably modified and realized within a range of the scope of the present invention, for example, as described below.

Figure 6:
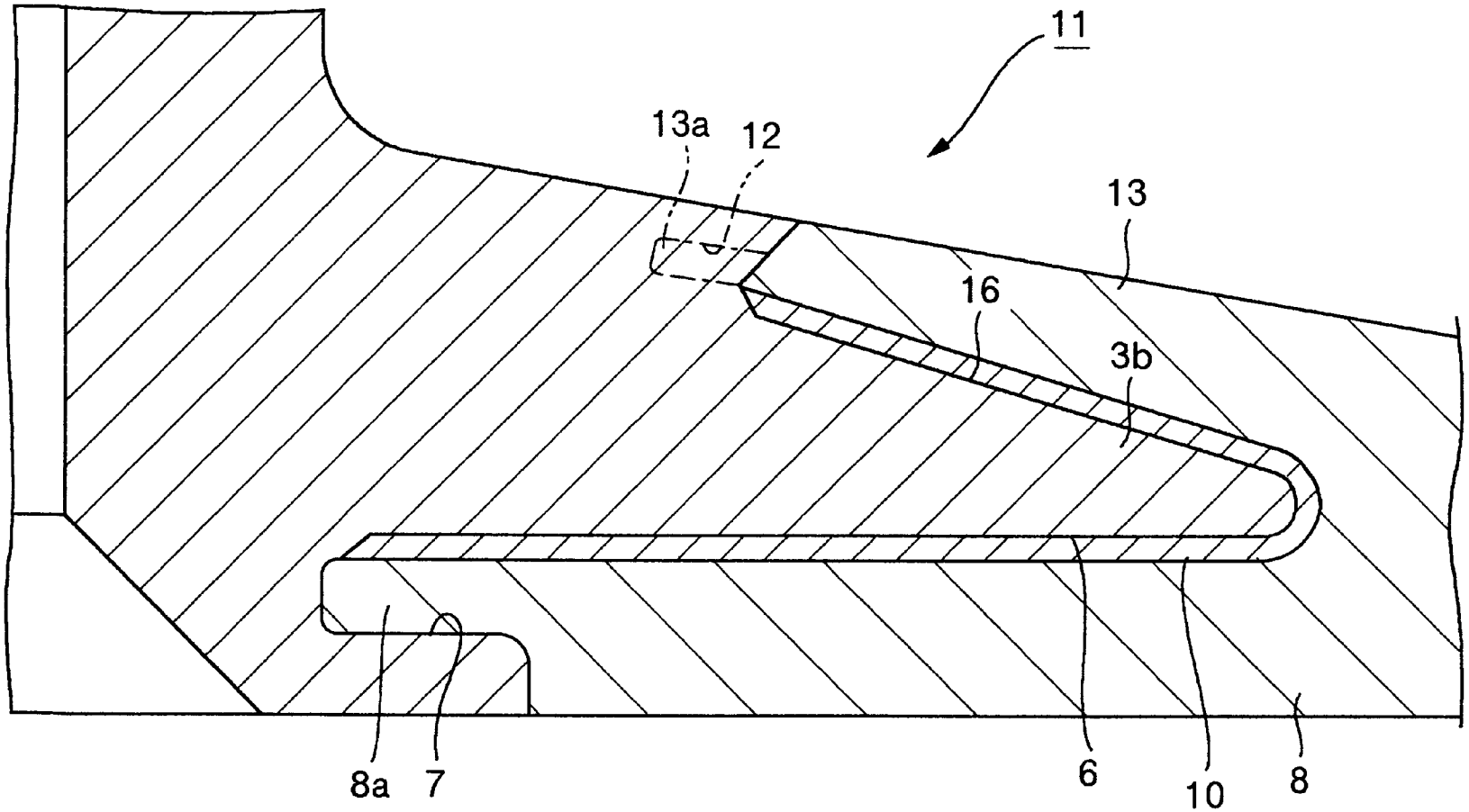
FIG. 6 is a cross sectional view which shows a main portion of a modified embodiment of a pressure container in accordance with the present invention.
Figure 7:
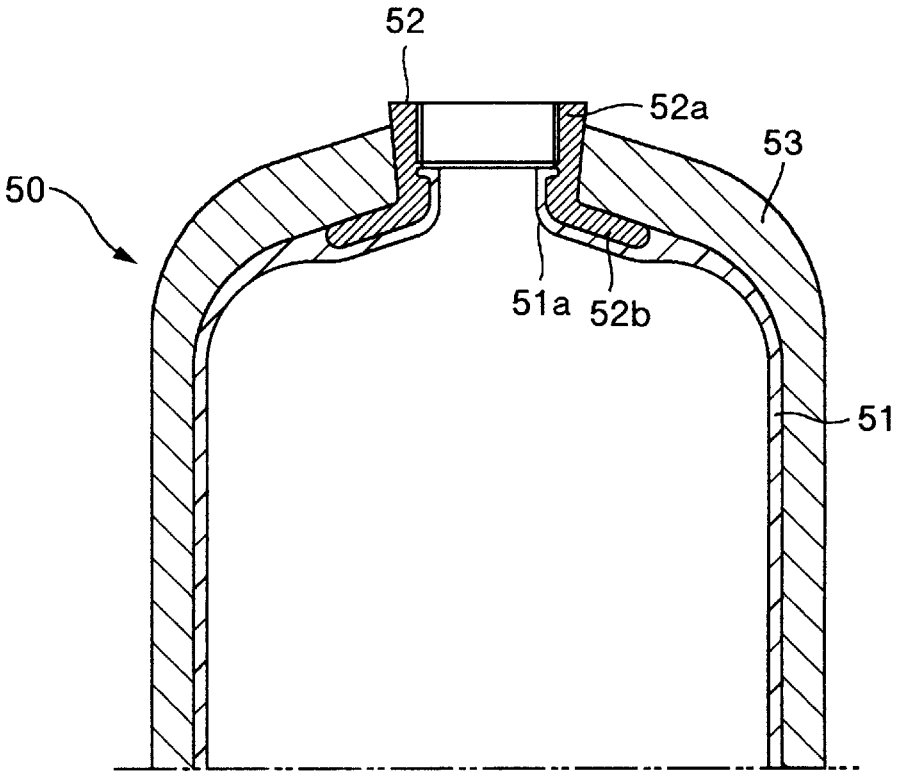
FIG. 7 is a cross sectional view of a pressure container in accordance with a conventional art.
Figure 8:
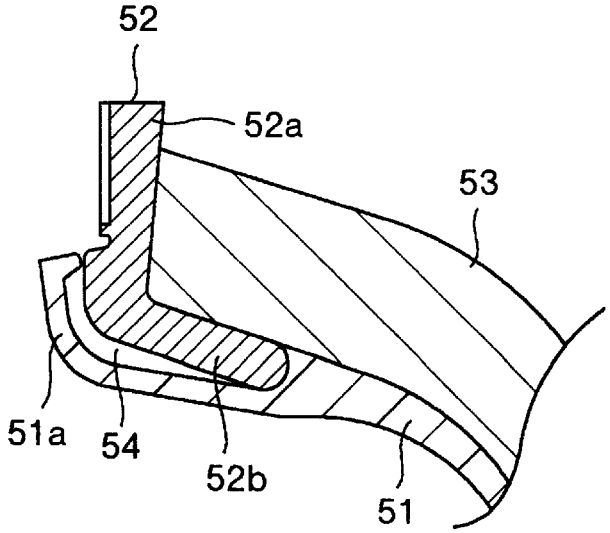
FIG. 8 is an enlarged view of a main portion of FIG. 7 which shows a mounting structure of a mouth piece in the pressure container.

(1) As shown in FIG. 6, the annular groove 7 is formed in a substantially horizontal shape so that the annular groove 7 comes near the center of the mouth piece 3 toward the bottom of the groove (not inclined so as to enter into a direction of the thickness of the flange portion 3*b*), and the inner peripheral portion 8*a* of the inner edge portion 8 of the liner 2 is formed in a shape of coinciding with the annular groove 7. Further, in the same manner, the outer annular groove 12 is formed in a shape so that the outer annular groove 12 comes near the center of the mouth piece 3 toward the bottom of the groove, and the inner peripheral portion 13*a* of the outer edge portion 13 of the liner 2 is formed in a shape of coinciding with the outer annular groove 12.

(2) The peripheral wall portion 2*a* and the end wall portions 2*b* and 2*c* in the liner 2 are integrally formed by a rotational molding method.

(3) The angles of incline A1 and A2 of the annular groove 7 and the outer annular groove 12 are suitably changed.

What is claimed is:

1. A pressure container comprising:

a mouth piece having a cylindrical boss portion and a flange portion which is protruded from an outer periphery of said boss portion; and a synthetic resin liner which is integrally formed in said flange portion, wherein an annular groove to which an inner peripheral portion of an edge portion of said liner is fitted so as to slide in a direction of expanding a diameter is provided on an inner side surface or an outer side surface of said flange portion.

2. A pressure container as claimed in claim 1, wherein said annular groove is formed in such a manner as to come nearer a center of the mouth piece toward a bottom of the groove, and the inner peripheral portion of the edge portion of the liner is formed so as to coincide with a shape of said annular groove.

3. A pressure container as claimed in claim 1, wherein said annular groove is formed in an inclined manner so that a bottom side of the groove comes nearer a center of the mouth piece and enters in a direction of a thickness of the flange portion, and the inner peripheral portion of the edge portion of the liner is formed in an inclined shape by being bent so as to coincide with said annular groove.

4. A pressure container as claimed in any one of claims 1 to 3, wherein said flange portion is structured such that a rubber coat is tightly formed on a contact surface with said liner.

* * * * *